US006901782B2

(12) United States Patent
Mikami et al.

(10) Patent No.: US 6,901,782 B2
(45) Date of Patent: Jun. 7, 2005

(54) METHOD AND APPARATUS FOR FORMING A MODIFIED A CROSS-SECTION WIRE MATERIAL

(75) Inventors: Takao Mikami, Sakaiminato (JP); Yoshiki Masugata, Yonago (JP); Takao Karaoke, Hakuta (JP)

(73) Assignee: Hitachi Metals, Ltd., Tokyo (JP)

( * ) Notice: Subject to any disclaimer, the term of this patent is extended or adjusted under 35 U.S.C. 154(b) by 63 days.

(21) Appl. No.: 10/310,810

(22) Filed: Dec. 6, 2002

(65) Prior Publication Data

US 2004/0107758 A1 Jun. 10, 2004

(51) Int. Cl.[7] ..... B21B 1/18
(52) U.S. Cl. ..... 72/225; 29/888.07
(58) Field of Search ..... 72/224, 249, 289, 72/274, 276, 225, 234; 29/888.073

(56) References Cited

U.S. PATENT DOCUMENTS 1,606,875 A * 11/1926 Heinauer ..... 72/224
3,513,679 A * 5/1970 Dechene et al. ..... 72/225
4,085,490 A * 4/1978 McCormick et al. ..... 148/589
4,776,195 A * 10/1988 Fukuhara et al. ..... 72/224
4,833,906 A * 5/1989 Potucek ..... 72/206
5,304,262 A * 4/1994 Karaoke et al. ..... 148/589
6,247,225 B1 * 6/2001 Snitchler et al. ..... 29/599

FOREIGN PATENT DOCUMENTS

JP 63179017 A * 7/1988 ..... C21D/7/10
JP 05-15496 6/1993

* cited by examiner

*Primary Examiner*—Lowell A. Larson
(74) *Attorney, Agent, or Firm*—Sughrue Mion, PLLC

(57) ABSTRACT

A modified cross-section wire material is formed into piston rings such as oil-control rings for use in an engine. An apparatus of the present invention for forming the modified cross-section wire material has a forming unit (15) comprising in combination a non-powered pre-stage four-roll turks-head (16) and a powered post-staged four-roll turks-head (17). Disposed in tandem and downstream of the forming unit (15) is a non-powered finishing four-roll turks-head (21). A forming roll of the powered turks-head (17) has a diameter equal to or larger than 70 times as much as a height-of a flange of the material. In forming, the material is kept at a tension equal to or less than 300 N between the non-powered turks-head stand (16) and the powered turks-head (17), and at a tension of from 50 to 200 N between the forming unit (15) and the finishing turks-head (21).

10 Claims, 5 Drawing Sheets

Fig.3
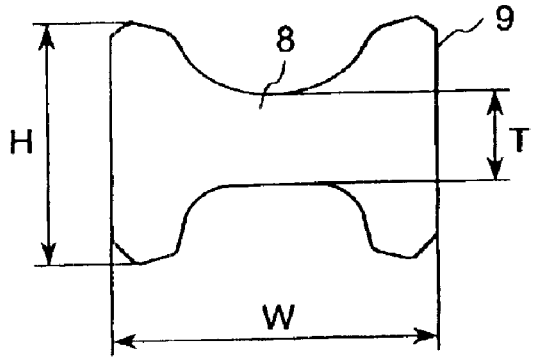
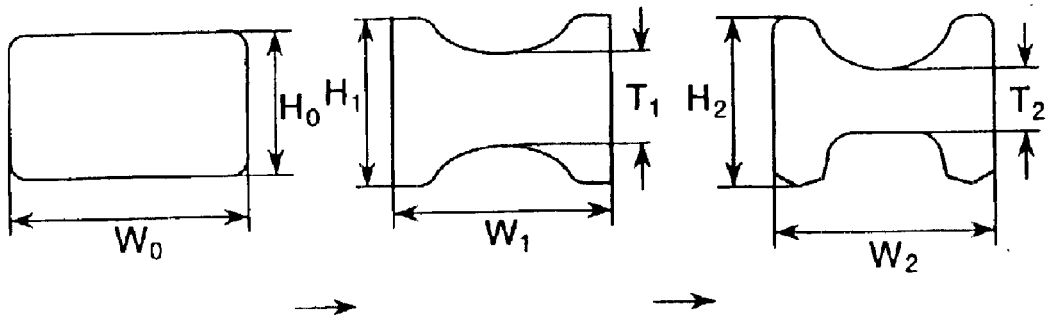
Fig.4(A) Fig.4(B) Fig.4(C)

Fig.5

Forming Experiment Data

Roughly Formed Material No. 1 Dimensions(mm) : $H_1$ =2.31, $T_1$ =1.51, $W_1$ =3.09

Finished Material No. 2 Dimensions(mm) : TABLE

| Rough Web Dimension (mm) | Formed Material (mm) | | | |
|---|---|---|---|---|
| | | φ125 (Non Powered) | φ250 (Non Powered) | φ250 (Powered) |
| 1.20 | Flange $H_2$ | 2.227 | 2.271 | 2.329 |
| | Web $T_2$ | 1.187 | 1.194 | 1.187 |
| | Width $W_2$ | 3.120 | 3.100 | 3.103 |
| | Draft Ratio$(T_1 - T_2)/T_1$ | 21.4 | 20.9 | 22.0 |
| | Fill-up Ratio$(H_2/H_1)$ | 0.96 | 0.98 | 1.01 |
| 1.10 | Flange $H_2$ | 2.218 | 2.267 | 2.343 |
| | Web $T_2$ | 1.099 | 1.104 | 1.090 |
| | Width $W_2$ | 3.120 | 3.098 | 3.107 |
| | Draft Ratio$(T_1 - T_2)/T_1$ | 27.2 | 26.9 | 27.8 |
| | Fill-up Ratio$(H_2/H_1)$ | 0.96 | 0.98 | 1.01 |
| 1.00 | Flange $H_2$ | 2.191 | 2.248 | 2.361 |
| | Web $T_2$ | 0.994 | 0.980 | 0.996 |
| | Width $W_2$ | 3.090 | 3.088 | 3.113 |
| | Draft Ratio$(T_1 - T_2)/T_1$ | 34.2 | 35.1 | 33.8 |
| | Fill-up Ratio$(H_2/H_1)$ | 0.95 | 0.97 | 1.02 |
| 0.95 | Flange $H_2$ | 2.184 | 2.247 | 2.366 |
| | Web $T_2$ | 0.931 | 0.940 | 0.933 |
| | Width $W_2$ | 3.090 | 3.090 | 3.083 |
| | Draft Ratio$(T_1 - T_2)/T_1$ | 38.3 | 37.7 | 38.2 |
| | Fill-up Ratio$(H_2/H_1)$ | 0.95 | 0.97 | 1.02 |

METHOD AND APPARATUS FOR FORMING A MODIFIED A CROSS-SECTION WIRE MATERIAL

BACKGROUND OF THE INVENTION

1. Field of the Invention

The present invention relates to a method and an apparatus for forming a modified cross-section wire material, for example such as the wire material adapted to be used in production of piston rings for use in an engine, and, more particularly to a method and an apparatus for forming a modified cross-section wire material adapted to be used in production of oil-control rings for use in the engine.

2. Description of the Related Art

As the engine power and the engine speed in an engine increase, a stress imposed on a piston ring used in the engine increases. Due to this, the piston ring of a conventional type made of cast iron is replaced with a steel piston ring made of stainless steels or any other suitable special steels. Particularly, as for an oil-control ring used in the engine (hereinafter referred to as the "oil ring"), as shown in FIG. 7, the oil ring is constructed of a modified cross-section wire material, for example such as an H-shaped steel-like wire material and the like having a complicated construction. Further, the oil ring is required to be formed with an extremely high accuracy in mass-production.

In a conventional method and apparatus for forming such a modified cross-section wire material in mass-production of the piston rings: first, a round wire material is formed into a square shape in cross section; and, the thus square-shaped wire material is then subjected to a drawing process through a plurality of passes in non-powered four-roll turks-head stands arranged in tandem, each of which stands includes four forming rolls 7, 7', as shown in FIG. 9. Further, such a drawing process is repeated many a time and oft, for example, three to five times, so that the square-shaped wire material is gradually formed into a finished-shape wire material best adapted for use in mass-production of the piston rings. As for the piston ring made of stainless steels or special steels, it is necessary to repeatedly perform an intermediate annealing process several times in the drawing process in order to straighten the wire material in the process. Particularly, the wire material made of high alloy steels requires both the drawing processes and the intermediate annealing process to be performed many times. This increases the number of the passes in production of a completed product of the wire material, and therefore increases the manufacturing cost of the product.

Consequently, in the art, there is a special need for a method and an apparatus for forming a modified cross-section wire material at low cost and with a high accuracy in dimension, wherein the method and the apparatus are capable of realizing a considerable reduction in cost, and a considerable reduction in each of the number of the drawing processes and the number of the intermediate annealing processes. However, in drawing the wire material by using the non-powered turks-head stands, a large drawing force is required to increase a reduction ratio of the wire material in cross-sectional area in each pass in each of the turks-head stands. When such a large drawing force is applied to the wire material, a large tension is applied to the wire material and extends the wire material along its length. When the wire material is formed into a finished wire material or product, for example such as one (shown in FIG. 3) assuming an H-shaped steel-like form in cross section and provided with a web portion 8 and a flange portion 9, the wire material is merely extended along its length and therefore reduced in its cross-sectional area. Due to such reduction in the cross-sectional area of the wire material, the thus drawn wire material often fails to sufficiently fill up a grooved pass opening formed between the forming rolls 7, 7' of each of the non-powered four-roll turks-head stands (shown in FIG. 9) when subjected to such a large tension applied to the wire material. As described above, in the conventional method and apparatus, it is necessary to reduce the reduction ratio of the wire material in cross section in each pass in order to: decrease the tension applied to the wire material; and, therefore sufficiently fill up the grooved pass opening of the forming rolls 7, 7' of each of the conventional turks-head stands with the wire material. This makes it impossible for the conventional method and apparatus to reduce the number of passes, wherein each pass is performed in each stand to gradually form the modified cross-section wire material, so that the passes are progressively faster than the one preceding.

As for means for solving the above problem inherent in the conventional method and the conventional apparatus for forming the modified cross-section wire material: it is necessary to increase a reduction ratio in cross-sectional area of the wire material passing through the grooved pass opening which is defined between the forming rolls of each of the turks-head stands. However, as described above, the forming rolls of each of the conventional turks-head stands are not powered. Due to this, it is necessary for each of the non-powered turks-head stands to perform its drawing operation of the wire material by using a capstan, which is capable of pulling the wire material passing through each of the conventional non-powered turks-head stands in the drawing operation. However, the use of such a capstan causes the wire material to be subjected to a large tension. Due to the presence of such a large tension in the drawing operation of the wire material, the wire material tends to be excessively extended lengthwise and often fails to sufficiently fill up the grooved pass opening of each of the turks-head stands, which makes it impossible to form the wire material with a high accuracy in dimension. Further, when the reduction ratio in cross-sectional area of the wire material is increased to realize a much more heavier pass in each stand, a crack often appears in a surface of the wire material due to its lengthwise extension under the influence of the large tension applied thereto by the capstan. This crack often results in almost full breakage of the wire material thus subjected to such a large tension.

Consequently, it is not possible to solve the problem by merely increasing the number of passes (i.e., the number of the turks-head stands) since the thus increased stands of the turks-heads merely increase the sum of tensions imposed on the wire material during the drawing operation, and therefore increase the risk of almost full breakage of the wire material. Due to this, in order to solve the wire-breakage problem, in the conventional method and the conventional apparatus for forming the modified cross-section wire material such as one shown in FIG. 3, it is necessary to divide the drawing operation of the wire material into three to five independent sub-drawing operations and further necessary to interpose an intermediate annealing process adjacent ones of these independent sub-drawing processes. Further, in the conventional method and the conventional apparatus using the non-powered turks-head stands, since a fill-up ratio of a flange portion of the wire material in the grooved pass opening of formed between the forming rolls of each turks-head stand is low, it is necessary to increase the wire material in size. However, such a large-sized wire material needs more drawing work, which increases the number of the intermediate annealing processes each to be performed adjacent ones of the independent sub-drawing operations in the conventional method and the conventional apparatus.

SUMMARY OF THE INVENTION

Under such circumstances, the present invention was made to solve the problems inherent in the prior art. Consequently, it is an object of the present invention to provide a method and an apparatus for forming a modified cross-section wire material with a high efficiency and a high accuracy in dimension using a minimum of installation cost, wherein both the number of passes and the number of intermediate annealing processes are reduced. More particularly, it is an object of the present invention to provide a method and an apparatus for forming a modified cross-section wire material adapted to be formed into a wire product or modified piston ring such as an oil-control ring, which is made of high alloy steels and has a complicated construction in cross section. It is also an object of the present invention to provide a method and an apparatus for forming a modified cross-section wire material, which is adapted to be formed into any other articles other than the piston rings.

The modified cross-section wire material is so defined here as to assumes, in cross section, any one of: an H-shaped form, an I-shaped form, an L-shaped form, an M-shaped form, a T-shaped form, a U-shaped form, a V-shaped form and an X-shaped form; other than any one of a simple square-shaped form, a simple rectangular form, a round form, an oval form and like simple forms. An example of the modified cross-section wire material is defined here and formed in the method and the apparatus of the present invention is shown in FIG. 7. This example is a piston ring, more particularly, an oil-control ring constructed of an H-shaped steel-like wire material having the H-shaped form in cross section.

In accordance with a first aspect of the present invention, the above object of the present invention is accomplished by providing:

An apparatus for forming a modified cross-section wire material comprising:

at least one forming unit (15), wherein the forming unit (15) is constructed of a non-powered pre-stage four-roll turks-head stand (16) and a powered post-staged four-roll turks-head stand (17) disposed in tandem and down-stream of the non-powered pre-stage four-roll turks-head stand (16);

when a plurality of the forming units (15) are provided in the apparatus, the plurality of the forming units (15) are arranged in tandem to form a forming line of the apparatus.

In the apparatus having the above construction, preferably the powered post-staged four-roll turks-head stand (17) includes a pair of vertically arranged forming rolls (18) and a pair of laterally arranged forming rolls (19). One of these two pairs of the forming rolls (18, 19) is powered to perform a rough rolling operation.

Further, preferably at least one pair of driving-roll of the forming rolls (18,19) of the powered post-staged four-roll turks-head stand (17) is constructed of a large-diameter roll having a diameter equal to or larger than 70 times as much as a thickness of the wire material.

Still further, disposed in tandem and downstream of the forming unit (15) or a row of the plurality of the forming units (15) arranged in tandem to form the forming line of the apparatus is preferably a non-powered finishing four-roll turks-head stand (21) arranged in a finishing line of the apparatus.

Further, preferably the wire material is kept at a tension equal to or less than 300 N between the non-powered pre-stage turks-head stand (16) and the powered post-stage turks-head stand (17), and then kept at a tension of from 50 N to 200 N between adjacent ones of said forming units (15) and further between the last one of said forming units (15) and said non-powered finishing turks-head stand (21).

Preferably, tension controlling means is provided to control: a tension of the wire material running between adjacent ones of the plurality of the forming units (15); and, a tension of the wire material running between the forming unit (15) and the non-powered finishing turks-head stand (21).

Further, the wire material is of an H-shaped steel-like type; and, the wire material is rolled to have its web portion kept at a draft ratio of from 10% to 15% in a grooved pass opening formed between one pair of forming rolls (7,7) of the non-powered pre-stage turks-head stand (16), and kept at a draft ratio of from 20% to 60% in a grooved pass opening formed between one pair of forming rolls (18,18) of the powered post-stage turks-head stand (17).

Still further, preferably the wire material is used in production of piston rings.

In accordance with a second aspect of the present invention, the above object of the present invention is accomplished by providing:

A method for forming a modified cross-section wire material comprising the steps of:

rolling the wire material by using at least one forming unit (15) constructed of a non-powered pre-stage four-roll turks-head stand (16) and a powered post-stage four-roll turks-head stand (17); or, rolling the wire material by using a plurality of the forming units (15) arranged in tandem in the forming line of the apparatus.

In the method having the above construction, preferably at least one pair of driving-roll of the forming rolls (18,19) of the powered post-staged four-roll turks-head stand (17) is constructed of a large-diameter roll having a diameter equal to or larger than 70 times as much as a thickness of the wire material.

Further, disposed in tandem and downstream of the forming unit (15) or a row of the plurality of the forming units (15) arranged in tandem in the forming line of the apparatus is preferably a non-powered finishing four-roll turks-head stand (21) arranged in a finishing line.

Still further, preferably the wire material is kept at a tension equal to or less than 300 N between said non-powered pre-stage turks-head stand (16) and said powered post-stage turks-head stand (17), and then kept at a tension of from 50 N to 200 N between the forming unit (15) and the non-powered finishing turks-head stand (21).

Further, preferably the wire material is reduced in cross-sectional area at a reduction ratio of equal to or less than 10% through a finishing pass performed in the non-powered finishing turks-head stand (21) with high accuracy in dimension.

Still further, preferably the wire material is of an H-shaped steel-like type; and, the wire material is rolled to have its web portion kept at a draft ratio of from 10% to 15% in a grooved pass opening formed between one pair of the forming rolls (7,7) of the non-powered pre-stage turks-head stand (16), and kept at a draft ratio of from 20% to 60% in a grooved pass opening formed between one pair of the forming rolls (18,18) of the powered post-stage turks-head stand (17).

Further, preferably the wire material is used in production of piston rings.

The present invention having the above construction is capable of effectively preventing the wire material from breaking in its forming process conducted with a high efficiency and high accuracy, and therefore capable of realizing a remarkable cost reduction and a remarkable improvement in productivity.

BRIEF DESCRIPTION OF THE DRAWINGS

The above and other objects, advantages and features of the present invention will be more apparent from the following description taken in conjunction with the accompanying drawings in which:

FIG. 3 is a cross-sectional view of the finished wire material after completion of the forming experiment shown in FIG. 2;

FIGS. 4(A), 4(B) and 4(C) are views illustrating variations of the wire material in cross section subjected to a series of the drawing and rolling operations according to the present invention;

FIG. 5 is a table showing the results of the forming experiment conducted according to the present invention;

DETAILED DESCRIPTION OF THE PREFERRED EMBODIMENTS

Figure 1:
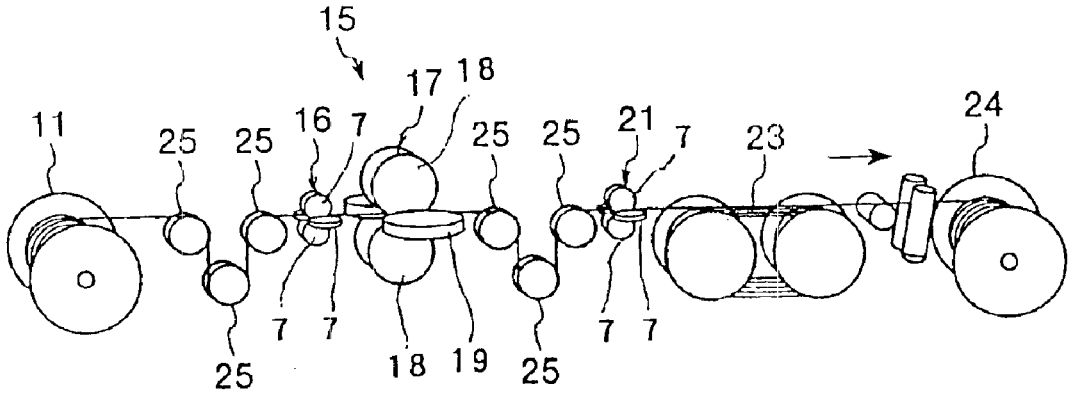
FIG. 1 is a perspective view of the apparatus of the present invention for forming the modified cross-section wire material.

The best modes for carrying out the present invention will be described in detail using embodiments of the present invention with reference to the accompanying drawings in which: the reference numeral 1 denotes a piston ring; 2 a coil expander; 4 a non-powered turks-head stand; 7, 7' a forming roll; 8 a web portion of a modified cross-section wire material; 9 a flange portion of the wire material; 11 a supply reel; 15 a forming unit; 16 a non-powered pre-stage four-roll turks-head stand; 17 a powered post-stage four-roll turks-head stand disposed in tandem and downstream of the pre-stage stand 16; 18 a powered vertical rolls: 19 non-powered lateral rolls 21 a non-powered finishing four-roll turks-head stand disposed downstream of the forming unit 15 and arranged in a finishing line; 23 a capstan; 24 a take-up reel; and, 25 a dancer roll.

FIG. 1 shows an embodiment of an apparatus of the present invention for forming a modified cross-section wire material.

The inventors of the present invention have studied the prior art, and performed extensive experiments many a time and oft to obtain the following findings:

① It is possible to reduce the number of the forming processes (i.e., passes) of the wire material by using a powered roll-type turks-head stand, wherein: the powered roll-type turks-head stand is capable of forming the wire material without applying any tension to the wire material; and, therefore it is possible to improve a fill-up ratio of a flange portion of the wire material (for example such as the wire material of an H-shaped steel-like type) in a grooved pass opening defined between the forming rolls of the turks-head stand;

② It is possible to increase the fill-up ratio of the flange portion of the wire material in the grooved pass opening of the turks-head stand by increasing a diameter of each of the forming rolls of the turks-head stand;

③ On the other hand, as for dimensional accuracy of the finished wire material, a non-powered turks-head stand is often superior to the powered turks-head stand; and ④ It is important that the method for forming the modified cross-section wire material is suitable for a computer-integrated flexible forming system of the wire material and excellent in setup operation in production of the wire material, wherein the computer-integrated flexible forming system is defined as one used when the volume of production is relatively low and there are a wide variation of products to be produced. It is also important for the grooved pass opening of the forking rolls to be sufficiently flexible in design. Further, it is also important that the turks-head stand is sufficiently rigid in construction.

In order to accomplish the object of the present invention on the basis of the above findings, the apparatus of the present invention for forming a modified cross-section wire material comprises at least one forming unit 15. The forming unit 15 is constructed of both the non-powered pre-stage four-roll turks-head stand 16 and the powered post-staged four-roll turks-head stand 17. As shown in FIG. 1, this powered post-stage turks-head stand 17 is disposed in tandem and downstream of the non-powered pre-stage turks-head stand 16. In the apparatus of the present invention, when a plurality of the forming units 15 are provided in the apparatus, the plurality of the forming units 15 are arranged in tandem to form a forming line of the apparatus.

In other words, in the forming line of the apparatus, the non-powered pre-stage turks-head stand 16 is combined with at least one of the powered post-stage turks-head stands 17 to form the forming unit 15. In drawing operation of the wire material, the powered post-stage turks-head stand 17 performs a rolling operation of the wire material and is therefore capable of effectively pulling the wire material passing though the non-powered pre-stage turks-head stand 16, so that the non-powered pre-stage turks-head stand 16 is rotatably driven by the thus pulled wire material. More specifically, in the drawing operation, the wire material is drawn with a high accuracy in dimension through the grooved pass opening defined between the forming rolls 7,7' of the non-powered pre-stage turks-head stand 16, and is therefore supplied to the powered post-stage turks-head stand 17 disposed downstream of the non-powered pre-stage turks-head stand 16. Due to this, it is possible for the apparatus of the present invention: to precisely draw the wire material with a high accuracy in dimension; and, to draw the thus precisely drawn wire material with an improved fill-up ratio in the grooved pass opening defined between the forming rolls 7,7' of the powered post-stage turks-head stand 17, which results in an improvement in reduction ratio of the cross-sectional area of the wire material in the powered post-stage turks-head stand 17 to realize a so-called "much more heavier reduction" in the subject pass than would be realized in the corresponding pass of the prior art, so that the total number of the passes of the wire material required in the apparatus is remarkably reduced.

In the apparatus of the present invention, it is also possible to provide a plurality of the forming units 15 each having the same construction as that described above, wherein the plurality of the forming units 15 are arranged in tandem in the forming line of the apparatus. Due to such tandem arrangement of the forming units 15 in the forming line, it is possible for the apparatus of the present invention to form the wire material into a product such as a piston ring assuming the above-mentioned shape through only a single pass or a couple of passes of the wire material through the forming unit or units 15.

In contrast with this, the conventional apparatus for forming the modified cross-section wire material needs much more passes of the wire material through the forming units 15, and further needs a cumbersome intermediate annealing processes each interposed between adjacent ones of the forming processes performed in the forming units 15. As for the conventional forming process of the wire material, the conventional forming process is divided into three or five groups each comprising a single pass of the wire material passing through the grooved pass opening defined between the forking rolls of each of the turks-head stands. Due to this, the conventional forming process of the wire material is cumbersome in setup operation.

Consequently, in comparison with the conventional apparatus carrying out such cumbersome forming processes and intermediate annealing processes, it is clear that the apparatus of the present invention is capable of eliminating such a cumbersome annealing processes together with such cumbersome forming processes, and therefore capable of realizing a remarkable improvement in both productivity and cost reduction.

Incidentally, the forming unit 15 defined here refers to not only an integrally assembled single unit from both the non-powered pre-stage turks-head stand 16 and the powered post-stage turks-head stand 17, but also refers to a network of the non-powered pre-stage turks-head stand 16 and the powered post-stage turks-head stand 17, provided that these turks-head stands 16, 17 are functionally combined through telecommunication means even when they 16, 17 are separately arranged in location. Further, in the apparatus of the present invention, it is also possible to combine the powered post-stage turks-head stand 17 with a single one or a plurality of ones of the non-powered pre-stage turks-head stands 16.

The powered post-stage turks-head stand 17 is preferably of a four-roll type comprising a pair of vertical forming rolls 18 and a pair of lateral forming rolls 19. One pair of these two pairs of the forming rolls 18, 19 is powered to perform a rough rolling operation of the wire material, in which one pair 18 or 19: one of the forming rolls 18 or 19 performing such rough-rolling operation is provided with an annular groove portion in its outer peripheral surface, which annular groove portion cooperates with a flat peripheral surface of the other forming roll 18 or 19 to define a grooved pass opening between these forming rolls 18,18,19,19. Consequently, in the above one pair of the forming rolls 18,19: as the diameter of the forming roll 18 or 19 increases, the fill-up ratio of the wire material in the grooved pass opening of the forming rolls 18,19 increases. Further, such large-diameter forming rolls 18,19 facilitate the setup operation of the apparatus of the present invention, and make it easy to handle the apparatus.

Preferably, each of the forming rolls 18,19 of the powered post-stage four-roll turks-head stand 17 has a diameter of equal to or larger than 70 times as much as a thickness of the wire material. As described above, the inventors of the present invention have found out, through extensive experiments, the fact that: as the diameter of the forming rolls 7, 7' of the conventional non-powered turks-head stand increases, the fill-up ratio of the wire material in the grooved pass opening increases. In the conventional apparatus, since a large drawing force is required in the drawing operation of the wire material when the diameter of the forming roll 7 or 7' of the non-powered pre-stage turks-head stand 16 increases, the conventional apparatus have heretofore used the forming rolls 7, 7' each having a diameter of at least approximately 50 times as much as a thickness of the wire material. In contrast with the conventional apparatus having the above construction, the apparatus of the present invention uses the powered forming rolls 18 or 19 each having a diameter of equal to or more than 70 times as much as the thickness of the wire material. Due to this, the apparatus of the present invention is capable of increasing the fill-up ratio of the wire material in the grooved pass opening formed between the forming rolls upper and lower 18,18 of the powered post-stage four-roll turks-head stand 17 thereof. In the apparatus of the present invention, it is also possible to increase the diameter of only each of the forming rolls 18, 19, which performs a rough rolling operation of the wire material in a condition in which the fill-up ratio is increased.

Incidentally, as for the forming rolls 7, 7' of the non-powered pre-stage turks-head stand 16, it is also true that: the more the forming rolls 7,7' increase in diameter, the more the fill-up ratio of the wire material in the grooved pass opening formed between the forming rolls 7,7, 7'7' increases. However, such large-diameter forming rolls also increase the installation cost thereof as is in the powered post-stage four-roll turks-head stand 17 in which its forming rolls 18,19 are increased in diameter in order to increase the drawing force of the wire material passing through the non-powered pre-stage turks-head stand 16.

Preferably, a non-powered finishing four-roll turks-head stand 21 is arranged in a finishing line of the apparatus, and disposed in tandem and downstream of the forming line constructed of the forming unit 15 or constructed of a series or row of a plurality of the forming units 15 arranged in tandem in the forming line of the apparatus. Further, in the drawing operation of the wire material, the finishing roll turks-head stand 21 accomplishes reduction of the wire material in its cross-sectional area at a ratio (i.e., reduction ratio) of equal to or less than 10%, preferably at a reduction ratio of equal to or less than 3%. This enables the finising roll turks-head stand 21 to finish the wire material with a high accuracy in dimension after the wire material is roughly formed at a large reduction ratio by the forming unit 15. It is also possible for the apparatus of the present invention to provide a plurality of the non-powered finishing four-roll turks-head stands 21, which are disposed in tandem and downstream of the forming unit 15 to form the finishing line of the apparatus.

Further, in the drawing operation, preferably the wire material is kept at a tension of equal to or less than 300 N between the non-powered pre-stage turks-head stand 16 and the powered post-stage turks-head stand 17, and kept at a tension of from 50 N to 200 N between adjacent ones of the forming units 15 in the forming line of the apparatus.

As described above, when the tension applied to the wire material is large, the fill-up ratio of the wire material in the grooved pass opening of the forming rolls 7,7' decreases. Due to this, it is necessary to increase the wire material in diameter. This requires in turn some means for controlling the tension of the wire material. In view of the above situation, in the forming unit 15 of the present invention, the wire material is pulled lengthwise by the forming rolls 18,19 of the powered post-stage four-roll turks-head stand 17 disposed downstream of the non-powered pre-stage stand 16, in the drawing operation of the wire material passing through the non-powered pre-stage stand 16. In the drawing operation, when such pulling force (i.e., drawing force) of the wire material is excessively increased, the forming rolls 18, 19 of the powered turks-head stand 17 tend to slip on the wire material. In order to prevent such slippage of the forming rolls 18,19 from occurring on the wire material, a tension applied to the wire material between the non-powered pre-stage turks-head stand 16 and the powered post-stage turks-head stand 17 is kept preferably at a value of equal to or less than 300 N. The value of the tension applied to the wire material may be determined by properly designing the grooved pass opening formed between the forming rolls 18,19, and further may be determined by controlling a rotating speed of each of the forming rolls 18,19 in the powered post-stage turks-head stand 17.

On the other hand, although it is also possible to keep the tension of the wire material at a value of "zero" between adjacent ones of the forming units 15 and between the forming line (constructed of at least one of the forming units 15) and the finishing line constructed of the finishing roll turks-head stand 21 disposed in tandem and downstream of the forming line of the apparatus, it is preferable to set the tension of the wire material at a value of from 50 N to 200 N in order to improve the wire material in straightness.

As means for keeping a tension of the wire material at a predetermined value in an easy manner, preferably the apparatus of the present invention is provided with means for controlling a tension of the wire material between adjacent ones of the forming units 15 and further between the forming line and the finishing line of the apparatus.

Further, in forming an H-shaped steel-like wire material, preferably a draft ratio of a web portion of the wire material is kept at a value of from 10% to 50% in the grooved pass opening defined between the forming rolls 7,7' of the non-powered pre-stage four-roll turks-head stand 16, and kept at a value of from 20% to 60% in the grooved pass opening defined between the forming rolls 18,19 of the powered post-stage four-roll turks-head stand 17. An example of the above-mentioned H-shaped steel-like wire material is shown in FIG. 3 in cross section, and provided with a web portion 8 and a flange portion 9 in cross section. Here, the draft ratio of the web portion 8 of the wire material is defined by the following equation:

$$\text{Draft ratio}=((T1-T2)/T1)\times 100$$

where: T1 is the size of the web portion of the wire material not rolled, the size being given in millimeters; and, T2 is the size of the web portion of the wire material having been rolled, given in millimeters. In the drawing operation of the wire material, when the draft ratio of the wire material in the non-powered pre-stage four-roll turks-head stand 16 is kept at a value of equal to or less than 10%, it is necessary to increase the number of the passes of the wire material passing through the forming units 15. On the other hand, when the draft ratio of the wire material in the non-powered pre-stage four-roll turks-head stand 16 is kept at a value of equal to or more than 50%, the tension of the wire material excessively increases to cause the forming rolls 18,19 of the powered post-stage four-roll turks-head stand 17 to slip on the wire material. Further, when the draft ratio of the wire material in the powered post-stage turks-head stand 17 is kept at a value of equal to or less than 20%, it is often difficult to keep a sufficient fill-up ratio of the wire material in the grooved pass opening formed between the forming rolls 18,19 of the powered post-stage turks-head stand 17. On the other hand, when the draft ratio of the wire material in the powered post-stage turks-head stand 17 is kept at a value of equal to or more than 80%, the forming rolls 18,19 are often mechanically damaged in the drawing operation.

The method and the apparatus of the present invention are adapted for mass-production of the modified cross-section wire material, and particularly adapted for mass-production of a complicated cross-section wire material used in manufacturing a modified piston ring.

Forming Experiments

Figure 2:
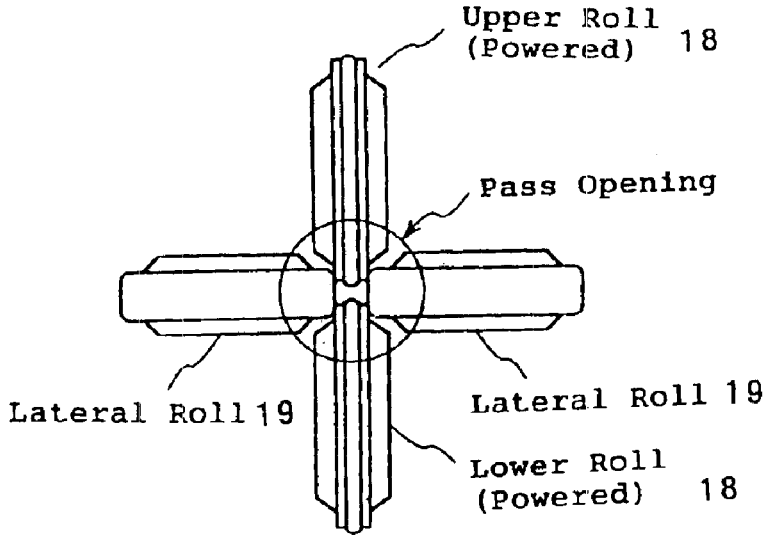
FIG. 2 is a front view of an essential part of the turks-head stand used in a forming experiment of the wire material conducted according to the present invention, illustrating an arrangement of forming rolls of the turks-head stand.
Figure 9:
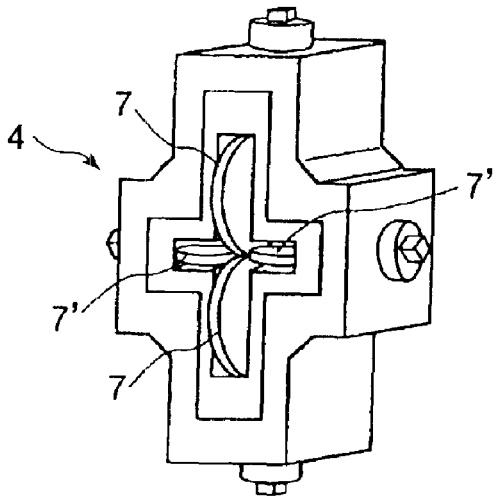
FIG. 9 is a perspective view of an essential part of the non-powered four-roll turks-head stand.

In order to obtain necessary data in designing of the forming unit 15 for forming the modified cross-section wire material, the inventor of the present invention performed extensive forming experiments under the following conditions by using a non-powered four-roll turks-head stand shown in FIG. 9. and a powered four-roll turks-head stand shown in FIG. 2, in which an upper and a lower roll are powered to pull the wire material lengthwise in the drawing operation of the wire material.

Experiment Conditions:

The wire material was made of a 0.85C–17Cr steel.

In an experimental forming process, the wire material varied in cross section in individual passes, as shown in FIGS. 4(A), 4(B) and 4(C).

① By using the wire material which assumes a square shape (thickness/width: $H_0/W_0$=2.30/3.20 in millimeters) in cross section as shown in FIG. 4(A), ② A rough forming operation of the wire material was conducted in a non-powered turks-head stand shown in FIG. 9, so that the wire material was roughly rolled to have dimensions: a flange's height H1/a web's size T1/a material's width W1=2.30/1.50/3.10 (in millimeters).

③ By using the thus roughly formed wire material and by varying both a draft ratio of the web portion of the wire material and a diameter of each the forming rolls of the non-powered turks-head stand and Dowered turks-head stand, as described below, wherein the wire material was formed to have a cross-sectional form shown in FIG. 4(C).

Finishing Conditions in the Forming Experiments:

The forming rolls used in the experiments:

① the forming rolls each having a diameter of 125 mm were used in a non-powered turks-head stand;

② the forming rolls each having a diameter of 250 mm were used in the non-powered turks-head stand; and ③ the forming rolls each having a diameter of 250 mm were used in a powered turks-head stand.

The size $T_2$ (given in millimeters) of the finished web portion of the wire material:

① 1.20;

② 1.10;

③ 1.00; and

④ 0.95.

All the results of the above experiments are shown in a table of FIG. 5. In the table shown in FIG. 5: the draft ratio of the web portion 8 of the wire material was defined by the following equation:

$$\text{Draft ratio}=((T_1-T_2)/T_1)\times 100$$

where: $T_1$ is the size of the web portion of the wire material not rolled, the size being given in millimeter; and, $T_2$ is the size of the web portion of the wire material having been rolled, the size being given in millimeter; and, the fill ratio of the wire material was defined by the following equation:

$$\text{Fill-up ratio}=H_2/H_1$$

where: $H_1$ was a height of the flange portion of the wire material not subjected to the rolling operation, the height being given in millimeter; and, $H_2$ was a height of the flange portion of the wire material having been subjected to the rolling operation, the height being given in millimeter.

Figure 6:
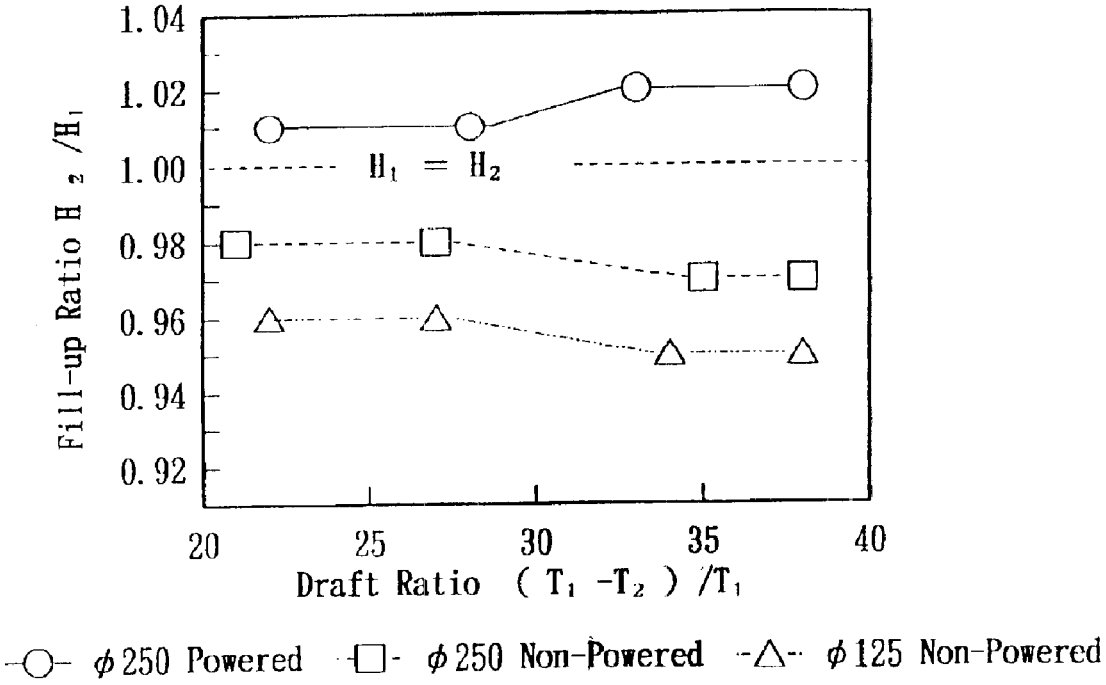
FIG. 6 is a graph showing the results of the forming experiment conducted according to the present invention.
Figure 7:
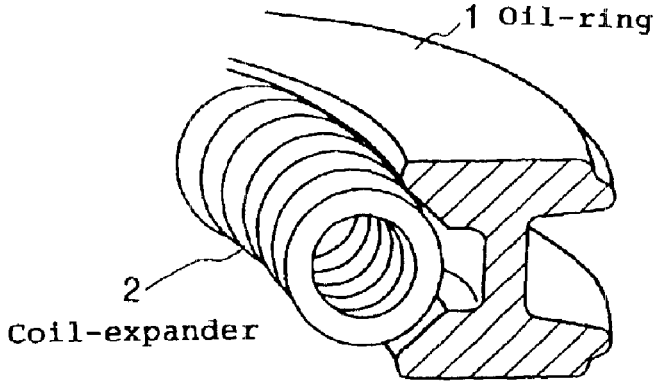
FIG. 7 is a perspective view of an example of an oil-control ring, illustrating the cross section of the oil-control ring.

From the results (shown in FIGS. 5 and 6) of the above forming experiments, the following findings are obtained:

① In the powered turks-head stand, the forming rolls each having a diameter of 250 millimeters were superior in fill-up ratio to the forming rolls each having a diameter of 125 millimeter of the non-powered turks-head stand. Further, the forming rolls each having a diameter of 250 millimeters in the powered turks-head stand were superior in fill-up ratio to the forming rolls each having a diameter of 250 millimeter of the non-powered turks-head stand;

② In the non-powered turks-head stand using the forming rolls each having a diameter of 125 millimeters or a diameter of 250 millimeters, a flange portion of the wire material having been formed was slightly reduced in height, so that the flange's height was less than a thickness of the wire material not formed by the forming rolls. In contrast with this, when the wire material was formed by the powered turks-head stand provided with the forming rolls each having a diameter of 250 millimeters, the height of the flange portion of the wire material was increased to be larger than the thickness of the wire material not formed by the forming rolls of the powered turks-head stand, so that the fill-up ratio of the wire material in the grooved pass opening defined between the forming rolls of the powered turks-head stand was increased;

③ In the non-powered turks-head stand provided with the forming rolls having a diameter of 125 millimeters or 250 millimeters: the more the draft radio of the wire material was increased, the more the tension applied to the wire material was increased. Due to this, the fill-up ratio of the wire material in the grooved pass opening was reduced. On the other hand, in the powered turks-head stand, it was found that: the more the draft ratio was increase, the more the fill-up ratio was increased; and ④ In the non-powered turks-head stand, the large-diameter forming rolls each having a diameter of 250 mm was larger in fill-up ratio than the small-diameter forming rolls each having a diameter of 125 mm.

Based on the above experimental results, the apparatus of the present invention for forming the modified cross-section wire material is designed. Now, the apparatus of the present invention will be described in detail.

FIG. 1 shows a perspective view of the apparatus of the present invention for forming the modified cross-section wire material.

The apparatus of the present invention comprises, from the left to the right in FIG. 1: the supply reel 11 for feeding the wire material; the forming unit 15 disposed in tandem and downstream of the supply reel 11; the non-powered finishing four-roll turks-head stand 21 disposed in tandem and downstream of the forming unit 15 in the finishing line; the capstan 23 disposed in tandem and downstream of the non-powered finishing turks-head stand 21; and, a take-up reel 24 disposed in tandem and downstream of the capstan 23. Interposed between the supply reel 11 and the forming unit 15 is a dancer roll 25 serving as means for controlling the tension of the wire material. Another dancer roll 25 for controlling the tension of the wire material is interposed between the forming unit 15 and the non-powered finishing turks-head stand 21. These dancer rolls 25 and capstan 23 serve as means for controlling a tension of the wire material to keep the wire material at a predetermined tension in the drawing operation of the wire material.

On the other hand, as is clear from FIG. 1, the forming unit 15 is constructed of: the non-powered pre-stage four-roll turks-head stand 16 and the powered post-stage four-roll turks-head stand 17 disposed downstream of the non-powered turks-head stand 16.

More specifically, the non-powered turks-head stand 16 is provided with a pair of vertical forming rolls 7 and a pair of lateral forming rolls 7', wherein each of the forming rolls 7, 7' has a diameter of equal to 50 times as much as a height "H" of the flange portion of the wire material, wherein the height is given in millimeter. On the other hand, the powered post-stage turks-head stand 17 is also provided with a pair of vertical forming rolls 18 and a pair of lateral forming rolls 19, wherein: each of the forming rolls 18,19 has a diameter of equal to 100 times as much as a height "H" of the flange portion of the wire material, the height being given in millimeter, and, only the vertical forming rolls 18 (shown in FIG. 2) are motor-powered in the powered post-stage turks-head stand 17.

On the other hand, the finishing turks-head stand 21 is not powered as is in the non-powered pre-stage turks-head stand 16, and also provided with a pair of vertical forming rolls 7 and a pair of lateral forming rolls 7'. In the drawing operation, the wire material is pulled lengthwise by the capstan 23 to pass through the grooved pass opening of the finishing turks-head stand 21 and is therefore finished in the finishing line of the finishing turks-head stands 21 with a high accuracy in dimension.

In this embodiment of the present invention, there is provided the single pre-stage turks-head stand 16 and a plurality of the post-stage turks-head stands 17. However, it is also possible for the apparatus of the present invention to use a plurality of the non-powered pre-stage turks-head stands 16. Further, in the embodiment of the present invention, though only one forming unit 15 is used, it is also possible to use a plurality of the forming units 15. Further, it is also possible to interpose the dancer roll 25 between adjacent ones of the forming units 15 to control the tension of the wire material therebetween. Further, it is also possible to use a plurality of the non-powered finishing turks-head stands 21 in the finishing line of the wire material.

EXAMPLE

Figure 8:
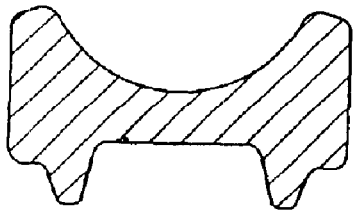
FIG. 8 is a cross-sectional view of a mass-produced product of the wire material produced by the method and the apparatus of the present invention.

By using the apparatus of the present invention having the above construction, a wire material made of a 0.65C–13Cr steel was formed into a modified cross-section wire material which was used in mass-production of a piston ring. A cross-sectional shape of the piston ring is shown in FIG. 8. Between the non-powered pre-stage turks-head stand 16 and the powered post-stage turks-head stand 17, the wire material was kept at a tension of approximately 200 N. And, between the forming unit 15 and the finishing turks-head stand 21, the wire material was kept at a tension of 100 N.

As a result, a wire product provided with a flange portion 9 and a web portion 8 was obtained with a high accuracy in dimension through only two passes of the wire material passing through the apparatus of the present invention without performing any intermediate annealing operation, wherein: each of the flange portion 9 and the web portion 8 of the wire product was formed with an accuracy of ±10 μm in dimension.

In the conventional apparatus, in order to produce a wire product such as one produced by the apparatus of the present invention, it is necessary to use three non-powered turks-head stands arranged in tandem in the drawing operation of the wire material. And repeat to draw three times in this apparatus. In other words, in the conventional apparatus, at least nine passes of the wire material are required. Further, the conventional apparatus performs the intermediate annealing process at least two times to produce the wire product.

In contrast with this, in the present invention, the number of the turks-head stands required is only three, as is clear from FIG. 1. Further, the number of the passes of the wire material required to pass through the apparatus of the present invention is only two, and no intermediate annealing process.

As described above, in the method and the apparatus of the present invention, since the forming unit 15 is constructed of the non-powered pre-stage four-roll turks-head stand 16 and the powered post-stage four-roll turks-head stand 17, it is possible to form the wire product with a high accuracy in dimension in the side of the non-powered pre-stage turks-head stand 16, and possible to realize a high fill-up ratio of the wire material in the side of the powered post-stage turks-head stand 17 without applying any excessive tension to the wire material.

Due to this, it is possible for the method and the apparatus of the present invention to produce the wire product through one or two passes of the wire material without using any intermediate annealing process or with only one intermediate annealing process even when the wire product is complicated in construction. In contrast with this, the conventional apparatus requires much more passes (for example, three or five pass stages) of the wire material in addition to the cumbersome intermediate annealing process required to be performed two or three times in the conventional apparatus when the wire product has a complicated construction.

In the powered post-stage four-roll turks-head stand 17: among its forming rolls 18, 19, as shown in FIG. 2, only the vertical forming rolls 18 are motor-powered. This contributes to simplification of the apparatus in construction and facilitates the setup operation of the apparatus, and further contributes to a remarkable cost reduction in the apparatus.

In the apparatus of the present invention, since each of the forming rolls 18, 19 of the powered post-stage turks-head stand 17 is constructed of a large-diameter roll having a diameter of more than 70 times as much as a thickness of the wire material, it is possible for the apparatus of the present invention to improve the fill-up ratio of the wire material in the grooved pass opening and also possible to reduce the number of the passes of the wire material.

Further, in the drawing operation, preferably the wire material is kept at a tension of equal to or less than 300 N between the non-powered pre-stage turks-head stand 16 and the powered post-stage turks-head stand 17, and kept at a tension of from 50 N to 200 N between adjacent ones of the forming units 15 in the forming line of the apparatus. Due to the above arrangement, there is no fear that the forming rolls 18, 19 of the powered turks-head stand 17 slip on the wire material. This makes it possible for the method and the apparatus of the present invention to produce a wire product excellent in straightness.

Further, in the apparatus of the present invention, since the non-powered finishing four-roll turks-head stand 21 in the finishing line is disposed in tandem and downstream of the forming unit 15 in the forming block of the apparatus, it is possible for the forming unit 15 to considerably reduce the wire material in cross-sectional area through a roughing pass in each forming unit 15. And, after completion of such considerable reduction in the cross-sectional area of the wire material, the wire material is then finished by the non-powered finishing four-roll turks-head stand 21 with high accuracy in dimension.

Further, in forming an H-shaped steel-like wire material, the wire material is rolled to have its web portion kept at a draft ratio of from 10% to 15% in the grooved pass opening formed between the forming rolls 7,7' of the non-powered pre-stage turks-head stand 16, and kept at a draft ratio of from 20% to 60% in the grooved pass opening formed between the forming rolls 18,19 of the powered post-stage turks-head stand 17, so that each of the grooved pass openings is effectively filled with the wire material to enhance the rolling operation thereof, whereby the method of the present invention for forming the modified cross-section wire material is remarkably improved in efficiency.

Since the apparatus of the present invention has the above construction, it is possible for the apparatus of the present invention to form the modified cross-section wire material through only two stages of the forming processes of the wire material using only three turks-head stands 16, 17 and 21 without using any intermediate annealing process. In contrast with this, the conventional apparatus requires nine rolling stands in total to form the modified cross-section wire material, wherein the nine rolling stands are divided into three groups in each of which a rolling operation of the wire material is separately conducted and therefore poor in efficiency.

The effect of the present invention resides in that: as described above, it is possible for the method and the apparatus of the present invention to form the modified cross-section wire material through only two stages of the forming processes using only three turks-head stands in total without using any intermediate annealing process; due to this, it is possible for the present invention to realize a remarkable cost reduction and a remarkable improvement in productivity. Although the modified cross-section wire material formed according to the method and the apparatus of the present invention is used in mass-production of the piston rings, it is also possible to use the modified cross-section wire material in production of any other articles of various types.

What is claimed is:

1. An apparatus for forming a modified cross-section wire material used as piston rings comprising:

at least one forming unit (15), wherein said forming unit (15) is constructed of a non-powered pre-stage four-roll turks-head stand (16) and a powered post-staged four-roll turks-head stand (17) disposed in tandem and downstream of said non-powered pre-stage four-roll turks-head stand (16)

wherein said cowered post-staged turks-head stand (17) includes a pair of vertically arranged forming rolls (18) and a pair of laterally arranged forming rolls (19); and, only one pair of said two pairs of said forming rolls (18,

19) is powered to perform a rough rolling operation of said wire material, and wherein at least one pair of driving-roll of said forming rolls (18, 19) of said powered post-staged turks-head stand (17) is constructed of a large-diameter roll having a diameter equal to or larger than 70 times as much as a thickness of said wire material.

2. The apparatus for forming the modified cross-section wire material used as piston rings, as set forth in claim 1, wherein: disposed in tandem and downstream of said forming unit (15) is a non-powered finishing turks-head stand (21) arranged in a finishing line of the apparatus.

3. The apparatus for forming the modified cross-section wire material used as piston rings as set forth in claim 2 wherein: said wire material is kept at a tension equal to or less than 300 N between said non-powered pre-stage turks-head stand (16) and said powered post-stage turks-head stand (17), and then kept at a tension of from 50 N to 200 N between adjacent ones of said forming units (15) and further between the last one of said forming units (15) and said non-powered finishing turks-head stand (21).

4. The apparatus for forming the modified cross-section wire material used as piston rings as set forth in claim 3 wherein tension controlling means (25) is provided to control: a tension of said wire material running between adjacent ones of said plurality of said forming units (15); and, a tension of said wire material running between said forming units (15) and said non-powered finishing turks-head stand (21).

5. The apparatus for forming the modified cross-section wire material is used as piston rings as set forth in claim 1 wherein: said wire material is of an H-shaped steel-like type; and, said wire material is rolled to have its web portion kept at a draft ratio of from 10% to 15% in a grooved pass opening formed between said one pair of forming rolls (7,7) of said non-powered pre-stage turks-head stand (16), and kept at a draft ratio of from 20% to 60% in a grooved pass opening formed between said one pair of forming rolls (18, 18) of said powered post-stage turks-head stand (17).

6. A method for forming a modified cross-section wire material used as piston rings comprising the steps of:

rolling said wire material by using at least one forming unit (15) constructed of a non-powered pre-stage four-roll turks-head stand (16) and a powered post-stage four-roll turks-head stand (17), wherein at least one pair of driving-roll of said forming rolls (18, 19) of said powered post-staged four-roll turks-head stand (17) is constructed of a large-diameter roll having a diameter equal to or larger than 70 times as much as a thickness of said wire material.

7. The method for forming the modified cross-section wire material used as piston rings as set forth in claim 6, wherein: disposed in tandem and downstream of said fanning unit (15) is a non-powered finishing turks-head stand (21) arranged in a finishing line following said forming line.

8. The method for forming the modified cross-section wire material used as piston rings as set forth in claim 7 wherein: said wire material is kept at a tension equal to or less than 300 N between said non-powered pre-stage turks-head stand (16) and said powered post-stage turks-head stand (17), and then kept at a tension of from 50N to 200 N between adjacent ones of said forming units (15) and further between the last one of said forming units (15) and said non-powered finishing turks-head stand (21).

9. The method for forming the modified cross-section wire material used as piston rings as set forth in claim 7, wherein: said wire material is reduced in cross-sectional area at a reduction ratio of equal to or less than 10% through a finishing pass performed in said non-powered finishing turks-head stand (21) with a high accuracy in dimension.

10. The method for forming the modified cross-section wire material used as piston rings as set forth in claim 6 wherein: said wire material is of an H-shaped steel-like type; and, said wire material is rolled to have its web portion kept at a draft ratio of from 10% to 15% in a groove pass opening formed between said one pair of forming rolls (7, 7') of said non-powered pre-stage turks-head stand (16), and kept at a draft ratio of from 20% to 60% in a grooved pass opening formed between said one pair of forming rolls (18—18) of said powered post-stage turks-head stand (17).

* * * * *